US007900881B2

(12) United States Patent
Campagna

(10) Patent No.: US 7,900,881 B2
(45) Date of Patent: Mar. 8, 2011

(54) MUSICAL INSTRUMENT SUPPORT STAND

(76) Inventor: Anthony J. Campagna, Carlsbad, CA (US)

( * ) Notice: Subject to any disclaimer, the term of this patent is extended or adjusted under 35 U.S.C. 154(b) by 0 days.

(21) Appl. No.: 11/751,570

(22) Filed: May 21, 2007

(65) Prior Publication Data

US 2008/0290227 A1 Nov. 27, 2008

(51) Int. Cl.
*A47G 23/02* (2006.01)

(52) U.S. Cl. ..... 248/153; 248/175; 248/206.5; 84/327; 84/329; 84/421; 211/85.6; 211/13.1; 211/71.01; 211/189; 211/DIG. 1

(58) Field of Classification Search ..... 248/153, 248/175, 206.5; 84/327, 329, 421; 211/DIG. 1, 211/85.6, 13.1, 71.01, 189
See application file for complete search history.

(56) References Cited

U.S. PATENT DOCUMENTS 1,180,735 A * 4/1916 Murray ..... 126/229
1,261,841 A * 4/1918 Mortensen ..... 84/327
1,369,742 A * 2/1921 Halpin ..... 248/175
1,578,493 A * 3/1926 Winton ..... 248/146
1,774,096 A * 8/1930 Hasterok et al. ..... 248/163.1
2,634,936 A * 4/1953 Meline ..... 211/41.7
2,639,334 A * 5/1953 Fleming ..... 379/455
2,969,155 A * 1/1961 Atkinson ..... 211/189
3,512,741 A 5/1970 Goldstein
3,737,137 A 6/1973 Sheehan
3,958,786 A * 5/1976 Mann ..... 248/176.3
4,029,347 A * 6/1977 Garcia ..... 289/16.5
4,036,462 A * 7/1977 Sheftel ..... 248/166
4,099,441 A * 7/1978 Landon ..... 84/327
4,176,580 A 12/1979 Gallegos
4,352,480 A * 10/1982 Gathright ..... 248/448
4,582,282 A * 4/1986 Gracie ..... 248/167
4,693,161 A * 9/1987 Uhrig ..... 84/327
5,372,346 A 12/1994 Upchurch et al.
5,472,098 A * 12/1995 Ho ..... 211/2
5,497,689 A * 3/1996 Hoshino ..... 84/327
5,544,560 A 8/1996 Biasini
5,556,064 A * 9/1996 Cowe ..... 248/172
5,726,369 A * 3/1998 Gilday ..... 84/327

(Continued)

OTHER PUBLICATIONS

International Search Report for PCT/US08/61649, mailed Sep. 5, 2008, 10 pages.

*Primary Examiner* — Anita M King
*Assistant Examiner* — Nkeisha J Smith
(74) *Attorney, Agent, or Firm* — Gazdzinski & Associates, PC

(57) ABSTRACT

A stand for a musical instrument is sturdy, durable and easy to construct. The stand supports a musical instrument, such as a guitar, in a substantially upright, readily accessible manner, yet the stand is easy to disassemble for ready transport or store in a low volume configuration. One embodiment of a stand includes a base for supporting a lower section of a musical instrument and a detachable neck that engages an upper section of the musical instrument. The base includes a front support rod, a back support rod spaced apart and extending parallel to the front support rod and a pair of side support rods extending between and connecting the front support rod and the back support rod. A plurality of legs extend from the base to provide stability. The neck support can be magnetically secured to the base in a substantially upright position when the stand is in an assembled configuration. When in a storage configuration, the neck support can be secured to base in a horizontal position, thereby providing a low profile.

16 Claims, 6 Drawing Sheets

U.S. PATENT DOCUMENTS 5,739,445 A * 4/1998 Terry et al. ..... 84/329
5,744,735 A 4/1998 Liao
6,070,346 A * 6/2000 Kowalczyk ..... 40/124.4
6,145,801 A 11/2000 Herring, Jr.
6,179,135 B1 1/2001 Simpson
6,323,406 B1 11/2001 Park
6,422,522 B1 * 7/2002 Woollen ..... 248/166
6,540,182 B1 * 4/2003 Wilfer ..... 248/121
6,588,715 B2 * 7/2003 Wilfer ..... 248/121
6,603,067 B1 8/2003 Woollen
6,811,127 B1 * 11/2004 Shiao ..... 248/206.5
6,835,883 B2 12/2004 Stevens
6,874,744 B2 4/2005 Rawlings et al.
6,891,099 B1 * 5/2005 Davis et al. ..... 84/421
6,948,694 B1 9/2005 Gilbert
7,084,337 B1 * 8/2006 Schroeder ..... 84/274
7,342,162 B2 * 3/2008 Tai ..... 84/327
7,396,987 B1 * 7/2008 Tentindo ..... 84/423 R
2002/0056793 A1 5/2002 Bell
2004/0074370 A1 4/2004 Oskorep
2004/0182984 A1 9/2004 Sandkuhl
2005/0000348 A1 1/2005 Workman
2005/0121567 A1 * 6/2005 Meuniot ..... 248/150
2005/0126366 A1 6/2005 Burch et al.
2006/0156896 A1 7/2006 Perkins
2006/0213358 A1 * 9/2006 Motsenbocker ..... 84/731
2007/0108361 A1 * 5/2007 Mathis ..... 248/441.1

* cited by examiner

MUSICAL INSTRUMENT SUPPORT STAND

BACKGROUND

1. Technical Field

Embodiments of the present invention relate to a musical instrument support stand. In particular, some embodiments relate to a readily transportable support stand for storing and displaying instruments, such as guitars, violins, violas, basses, banjos and the like.

2. Description of Related Art

Musicians are often faced with the challenge of temporarily supporting their instrument when it is not being played. Instruments such as guitars are subject to potential damage if simply laid flat on the floor, so it is common practice to lean the neck or head of the instrument against a piece of furniture or a wall.

Leaning the neck of such an instrument against a piece of furniture or the like often results in the upper part of the instrument sliding laterally, causing the entire instrument to fall to the floor, again resulting in damage to the instrument. Leaning the head of such an instrument against a wall or a piece of furniture has the added disadvantage of potentially putting the instrument out of tune due to the tuners in the head coming in contact with the wall or furniture.

Conventional musical instrument stands serve simply to sustain the musical instrument. Therefore, no provision for convenience in storing and carrying the musical instrument is made in the conventional stands. Additionally, the stands cannot even sustain the musical instruments stably.

That is, the conventional musical instrument stands are inconvenient in storing and carrying musical instruments because of the weights and sizes of the stands, and cannot sustain musical instruments stably due to the insufficient holding structures of the stands. In addition, many conventional stands tend to be bulky and not collapsible; consequently, they tend to be difficult to store and transport.

BRIEF SUMMARY OF EMBODIMENTS OF THE INVENTION

Accordingly, embodiments of the present invention have been made to overcome the problems associated with conventional stands. In accordance with various embodiments of the present invention, a musical instrument stand is provided that can be easily assembled, disassembled and stored. In addition, these stands can also be readily transportable and sturdy.

According to one embodiment of the present invention, a stand configured to hold a musical instrument has a base and a support neck. The base includes a front support member and a back support member spaced apart from the front support member and extending substantially parallel to the front support member. A first side support member is located on one side of the base and connects the front support member to the back support member. In addition, a second side support member is located on the other side of the base, which also connects the front support member to the back support member. The support neck has a first end configured to be fastened to the base and a latch configured to detachably engage a musical instrument held in the stand.

According to another embodiment of the present invention, a stand for a musical instrument supports a musical instrument, such as a guitar, in a substantially upright, readily accessible manner, yet the stand is easy to disassemble for ready transport or store in a low volume configuration.

According to a further embodiment, a stand for a musical instrument includes a base for supporting a lower section of a musical instrument and a detachable neck that engages an upper section of the musical instrument. The base includes a front support rod, a back support rod spaced apart and extending parallel to the front support rod and a pair of side support rods extending between and connecting the front support rod and the back support rod. A plurality of legs extend from the base to provide stability. The neck support can be magnetically secured to the base in a substantially upright position when the stand is in an assembled configuration. The neck support can be secured to the base in a horizontal position when the base is in a storage configuration. In one embodiment, the neck support is magnetically secured to base in the storage configuration.

Other features and aspects of the invention will become apparent from the following detailed description, taken in conjunction with the accompanying drawings, which illustrate, by way of example, the features in accordance with various embodiments of the invention.

It should be understood that the above exemplary Figures are not necessarily drawn to scale. Certain proportions thereof may be exaggerated, while others may be minimized. The figures are intended to illustrate various embodiments of the invention that can be understood and appropriately carried out by those of ordinary skill in the art.

DETAILED DESCRIPTION OF EXEMPLARY EMBODIMENTS OF THE INVENTION

Figure 1:
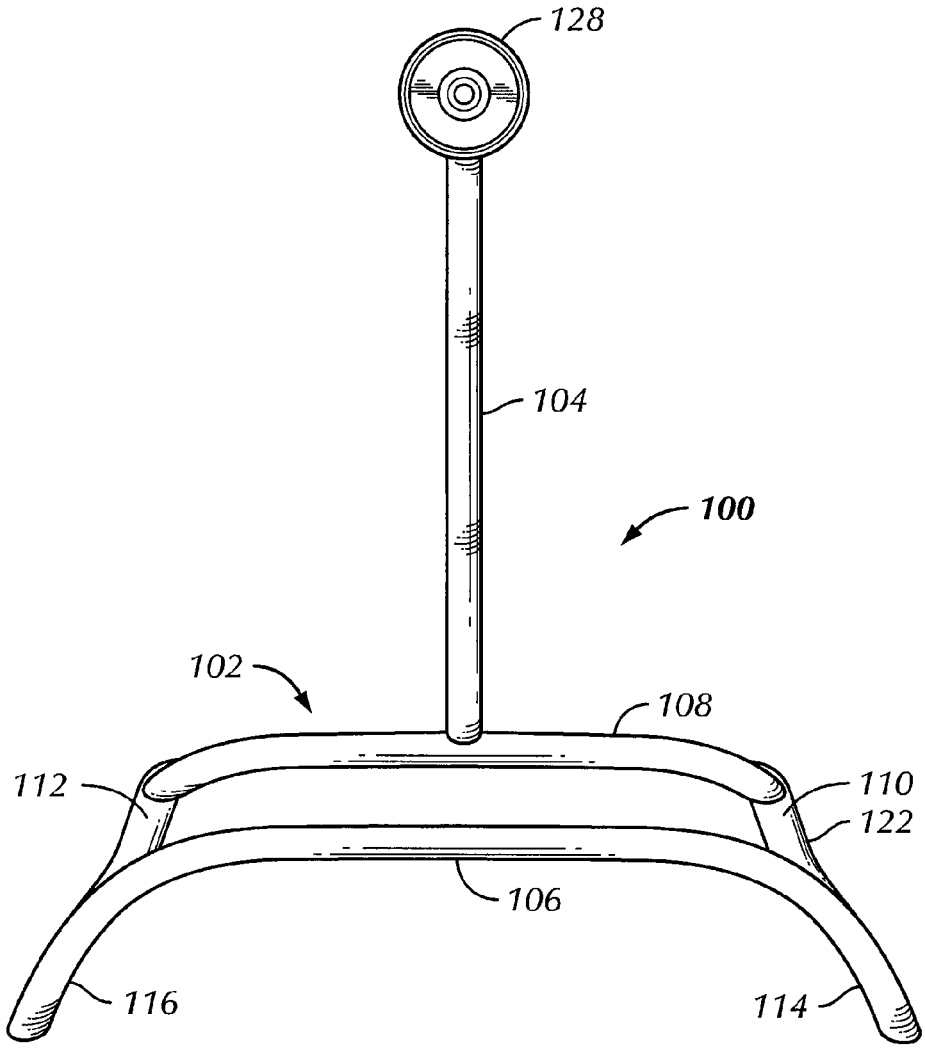
FIGS. 1 is a front view of a support stand in an assembled configuration in accordance with one embodiment of the present invention.
Figure 2:
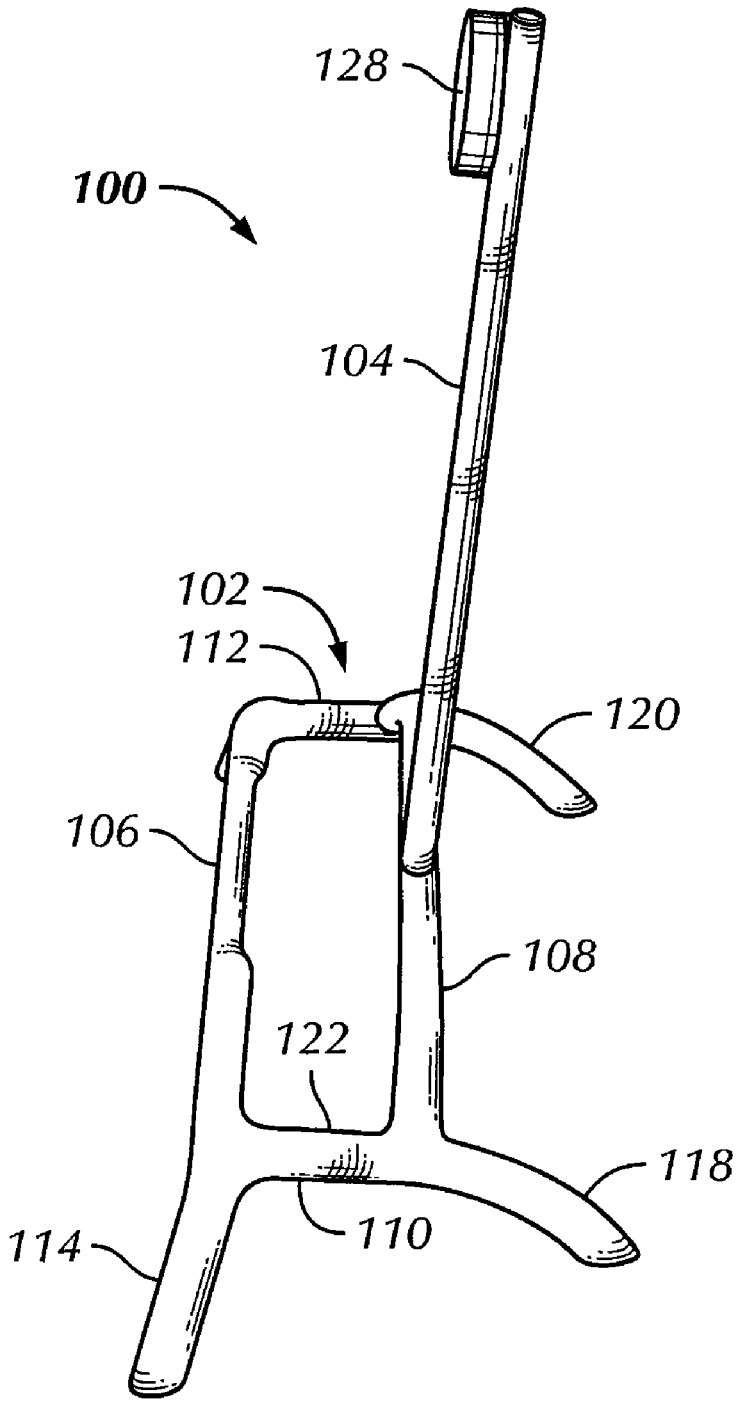
FIG. 2 is a side view of the support stand of FIG. 1.
Figure 3:
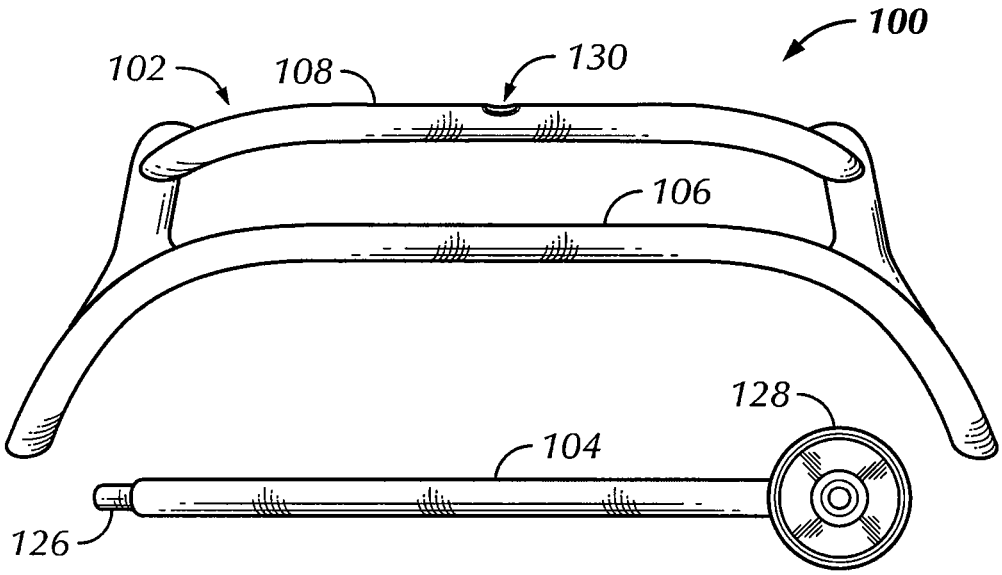
FIG. 3 is an elevated front view of the support stand of FIG. 1 in an unassembled configuration.

Referring now to the drawings, FIGS. 1 and 2 are respective front and side views of an embodiment of a stand 100 in an assembled configuration, and FIG. 3 is an elevated front view of the stand 100 in an unassembled configuration. The components of the stand 100 include a base 102 and a detachable support neck 104. The base 102 can include a front support 106 spaced apart and extending parallel to a rear support 108. First side support 110 and second side support 112 can connect the front support 106 and the rear support 108. The side supports 110 and 112 can also extend parallel to one another as well as be recessed relative to the top surfaces of the front and rear supports 106 and 108. In one embodiment, the side supports 110 and 112 are sufficiently recessed relative to the front and rear supports 106 and 108 so as to permit a guitar to be recessed with in the stand, but not recessed to the extent that knobs or other components of a guitar hit against the front support 106 or rear support 108 when the guitar is placed in the stand 100. The base 102 can also include a pair of front legs 114 and 116 (FIG. 1) and a pair of rear legs 118 and 120 (FIG. 2). Advantageously, the base 102 can have a low profile, yet also have a wide enough base for providing stability to the stand 100. A low profile can be beneficial in that the stand 100 does not unnecessarily consume space on a music store floor or stage, for example.

With further reference to FIGS. 1 through 3, the front support 106 and the pair of front legs 114 and 116 can be a single, curved rod. Similarly, the first side support 110 and the rear leg 118 can be a single curved rod and the second support 112 and the rear leg 120 can be a single curved rod, with each of the curved rods fastened at one end to the front support 106. The back support 108 can also be a single curved rod fastened at its ends to the first and second side supports 112 and 118. In one embodiment, the various sections of the base 100 are metal and welded together, but other known methods of fastening can also be used to either fasten the various sections together in a permanent or non-permanent fashion.

The base 102 can also include a notch 122 formed in one of the side supports 110 or 112. In the embodiment shown in FIGS. 1 and 2, the notch 122 is formed in the first side support 110, but in other embodiments, the notch can be formed in the second side support 112 or the notch 112 can be omitted. As described in more detail below, the notch 122 can serve to accept a cord attached to a guitar as well as serve to accept a section of the support neck 108 when the stand 110 is in a storage configuration. As also shown in FIG. 2, the front support 106 includes a cut-out section near the center portion of the front support 106, which is designed to accommodate the bridge of some guitars, for example, when placed into the stand.

In various embodiments, the support neck 104 can be detachably secured to the base 100. In other embodiments, the support neck 104 is permanently affixed to the base 100. In the embodiment shown in FIGS. 1 and 2, the support neck 104 extends not quite vertically from the base 100 in a slightly reclined stance. In this manner, a guitar held in the stand 100 can also have a slightly reclined stance.

Referring again to FIGS. 1 and 2, the support neck 104 can include a latch 128 located at an upper end of the support neck 104. The latch 128 can serve to fasten a portion of a guitar to the support neck 104. In accordance with various embodiments, the latch 128 has magnetic properties capable of having a strong engagement with, for example, a ferrous metal neck plate affixed to a guitar, as is explained in greater detail below. The latch 128 can include neodymium other known materials having suitable magnetic properties.

In various embodiments, the latch 128 can also include glow-in-the-dark material applied to its surface so that the latch 128 can be seen on a dark stage, for example. In addition, the glow-in-the-dark material can be in the form of a design or logo for advertising purposes.

In other embodiments, the latch 128 need not be magnetic. Instead, the latch 128 can be any other suitable type of latching mechanism configured to releasably secure a guitar to the support neck 104. In further embodiments, the latch 128 can be omitted so that a guitar held in the stand 100 merely rests against the support neck 104. In such embodiments, an abutment may be provided on the support neck 104 configured to support an upper portion of a guitar held in the stand 100.

Figure 4:
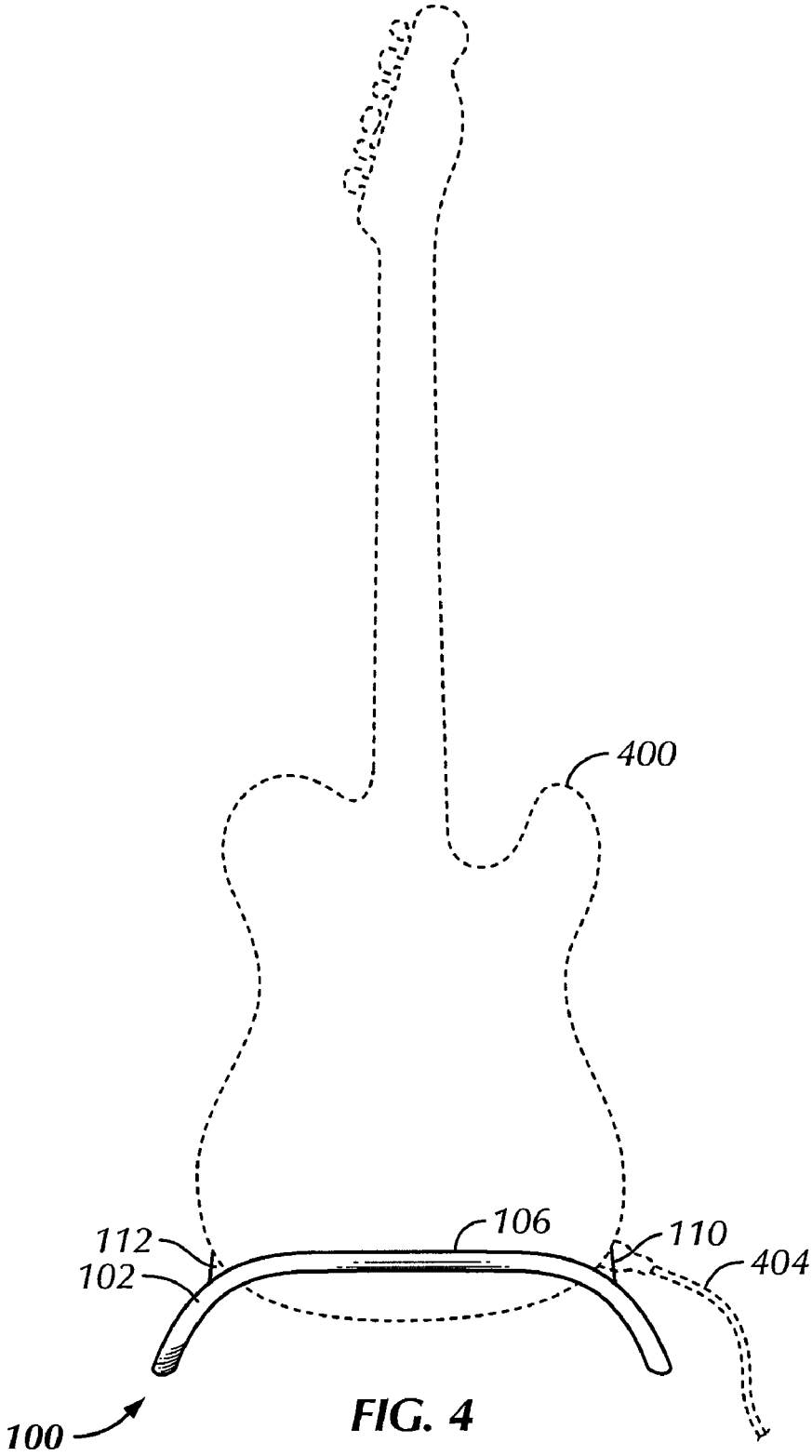
FIG. 4 is a front view of the support stand of FIG. 1 holding a guitar.
Figure 5:
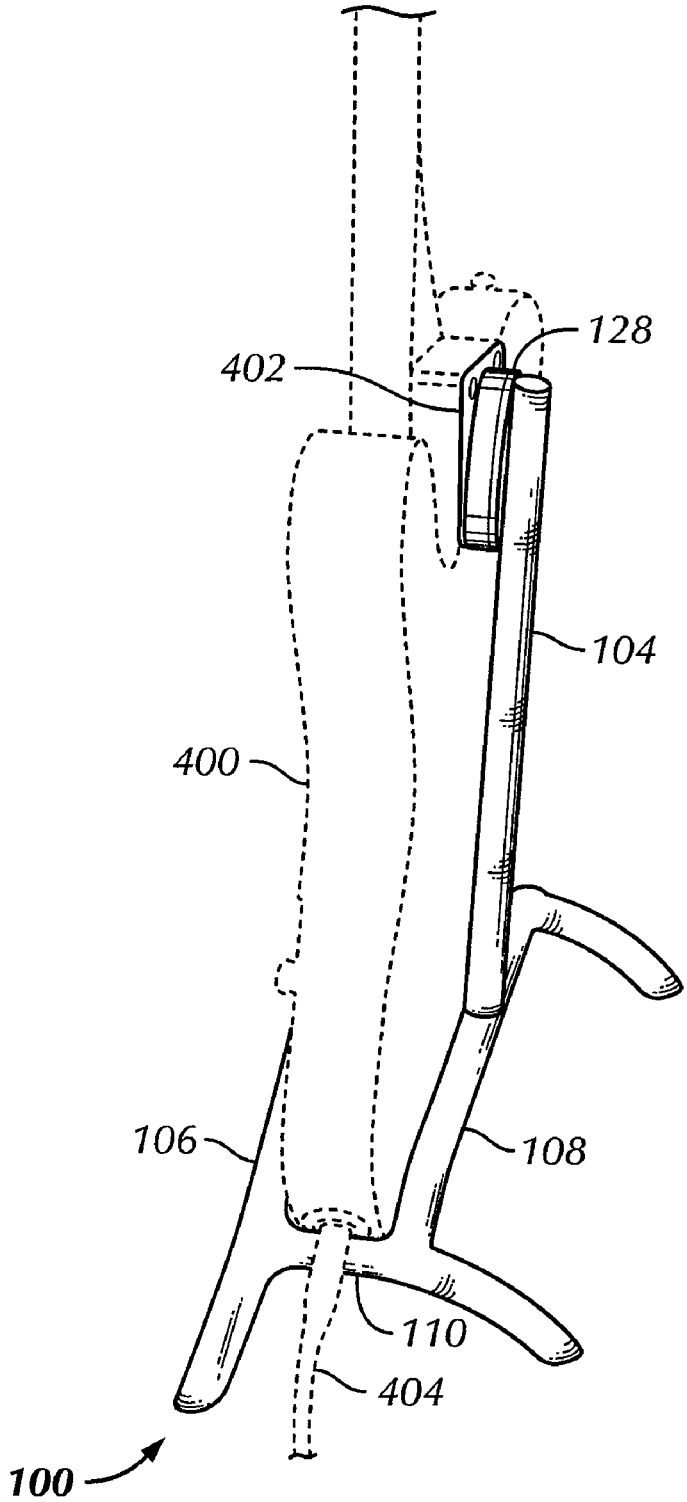
FIG. 5 is a side view of the support stand of FIG. 1 holding a guitar.

FIG. 4 is a front view of the stand 100 holding a guitar 400 and FIG. 5 is a back view of the stand 100 holding the guitar 400 in accordance with one embodiment of the present invention. As shown, the base 102 can support a lower portion of the guitar 400 and the support neck 104 can support an upper portion of the guitar 400. Specifically, the first side support 110 and second side support 112 support respective lower sides of the guitar 400. In addition, the rear support 108 supports a lower back portion of the guitar 400 and the front support 106 supports a lower front portion of the guitar 400. The latch 128 can be fastened to a metal neck plate 402 (FIG. 5) that is affixed to the back of the guitar 400. Also, when a cord 404 is attached to the guitar 400, a portion of the cord 404 can sit in the notch 122. Accordingly, the stand 100 can securely hold the guitar 400 in place in the above-described manner.

Figure 6:
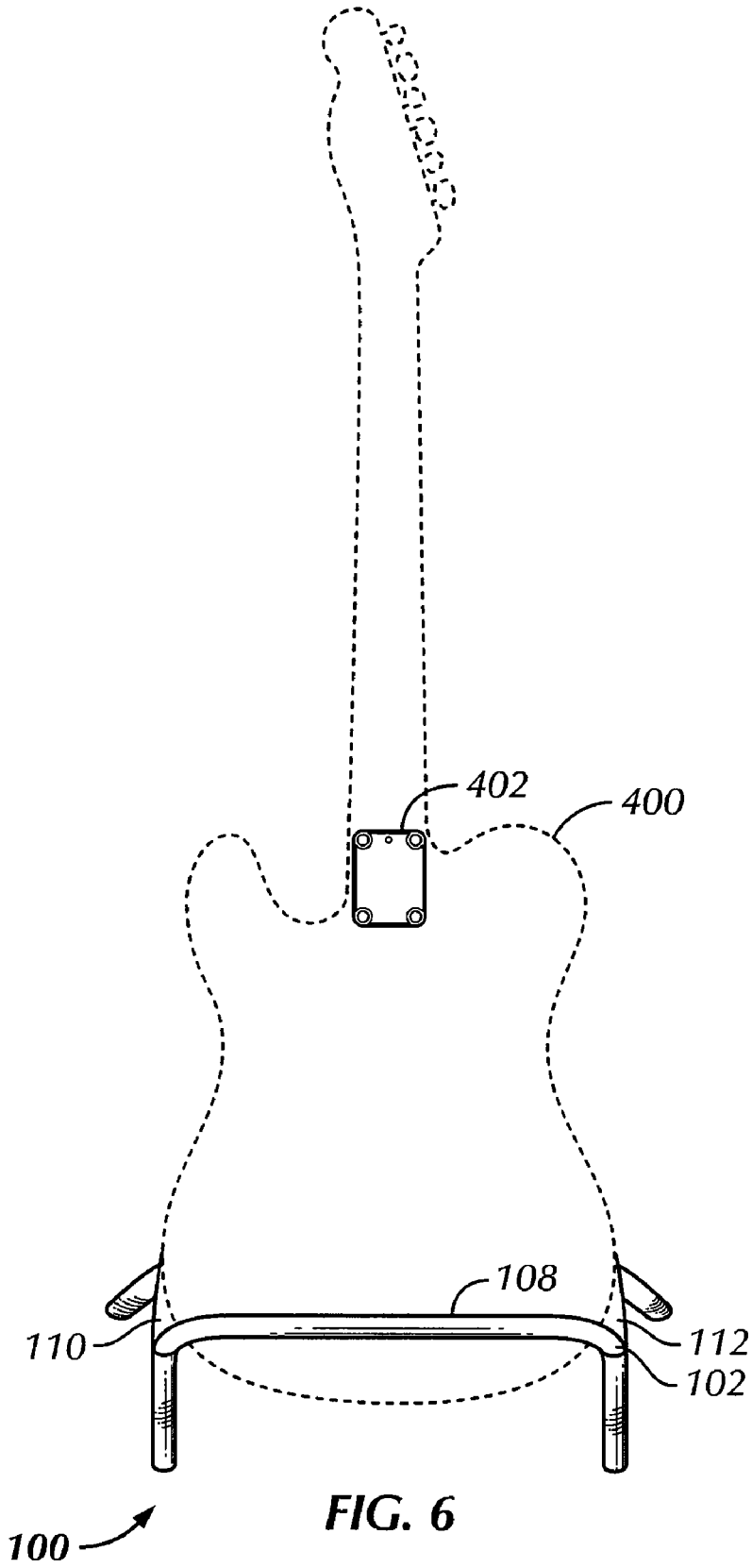
FIG. 6 is a back view of an embodiment of a support stand holding a guitar without the use of a support neck in accordance with one embodiment of the present invention.

As is known, some guitars are manufactured with a metal neck plate affixed to the back of the guitar, such as the neck plate 402 illustrated in FIGS. 5 and 6. However, for guitars that do not have a metal neck plate, a neck plate can be affixed to the guitar. Alternatively, a ferrous sticker can be applied to the guitar for providing a section for magnetically fastening the guitar to the latch 128. Such magnetic stickers are well known. Of course, other methods of affixing a suitable surface to the guitar for engagement with a magnetic latch can also be used.

Referring again to FIG. 3, the support neck 104 can be disengaged from the base 102. As can be seen, the support neck 104 includes a pin 126 at an end of the support neck 104. The pin 126 can be a reduced diameter section of the support neck 104 configured to fit inside a hole 130 formed in an upper surface of the rear support 108. The pin 126 can have a friction fit with the hole 130. In one embodiment, the pin 126 also has magnetic properties, which further secures the support neck 104 to the base 102. To assemble the stand 100, the support neck 104 can be secured to the base 102 by positioning the latch 128 facing forward and placing the pin 126 in the hole 130.

In one embodiment, magnetic materials used in the pin 126 and the base 100 are selected such that a user need only grip the guitar neck with one hand to pick up and move the stand 100 and the guitar 400 together. This can be advantageous when it is desired to move the stand 100 and guitar 400 together, such as when vacuuming under the stand 100 or when moving the stand to a different location on a stage, for example. Furthermore, since a user need use only one hand to move the stand 100 and guitar 400, the other hand is free to carry other objects, such as a vacuum or an additional musical instrument. Suitable magnetic materials to be used in the pin 126 can include neodymium or other known materials having suitable magnetic properties.

In one embodiment, to remove the support neck 104 from the base 102, a user can place his or her foot on the base 102 and pull the support neck 104 in a generally upward direction. As is understood, the amount of force required to remove the support neck 104 from the base 102 can depend upon the magnetic attraction between the pin 126 and the base 100.

Placing the guitar 400 in the stand 100 and removing the guitar 400 from the stand is described with reference to FIGS. 4 and 5. A user can place the guitar 400 in the stand 100 by placing a bottom portion of the guitar 400 between the front support 106 and rear support 108. The user can then recline the back of the guitar 400 against the latch 128 so that the latch 128 engages the neck plate located on the back of the guitar 400. To remove the guitar 400 from the stand, a user can place a foot on the base 102 and pull the guitar 400 away from the latch 128. Once the guitar 400 is released from the latch 128, the user lifts the guitar 400 out of the base 102 in a generally upward direction.

In one embodiment, the base 102 can hold the guitar 400 without the use of the detachable support neck 104. FIG. 6 is a back view of the base 102 supporting the guitar 400 without the use of a neck support 104 in accordance with one embodiment of the present invention. As shown, the first side support 110 and second side support 112 support respective sides of the guitar 400. In addition, the rear support 108 supports a back portion of the guitar 400 and the front support 106 supports a front portion of the guitar 400. When a user positions the guitar 400 into the base 102, the user can recline the guitar 400 towards the rear of the base 102 so that the front portion of the guitar 400 is leveraged against the front support 106 and the back portion of the guitar 400 is leveraged against the back support 108. In this manner, the base 102 can securely hold the guitar 400 in a slightly reclined, upright stance.

Figure 7:
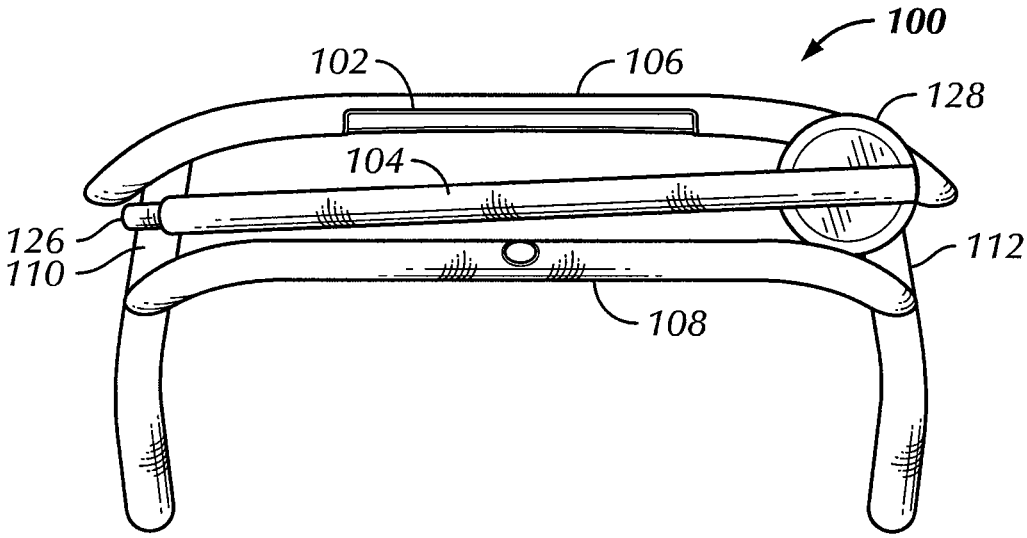
FIG. 7 illustrates the support stand of FIG. 1 in a storage configuration.

FIG. 7 shows the stand 100 in a storage configuration in accordance with one embodiment of the present invention. In the storage configuration, the stand 100 can be easily transportable and can be conveniently stacked on top of other stands. To place the stand 100 in the storage configuration, the support neck 104 can be positioned across the base 102, between the front support 106 and rear support 108, with the latch 128 contacting the second side support 112 and the pin 126 contacting the first side support 110. Advantageously, the latch 128 is magnetically fastened to the second side support 112 and the pin 126 is magnetically fastened to the first side support 110. In addition, the pin 126 can be located in the notch 122 (FIGS. 1 and 2). In one embodiment, the support neck 104 has sufficient magnetic attraction to the base 102 so that a user need only grasp the support neck 104 to carry the stand 100 while in its storage configuration.

In accordance with various embodiments of the present invention, the non-magnetic sections of the base 102 and support neck 104 can be made of a wide variety of materials, including plastic, metal, wood, or the like. In addition, all or a portion of the base 102 and support neck 104, including any magnetic portions, can be encapsulated with a dampening material. The dampening material can serve to cushion a guitar held in the stand 100, as well as reduce the likelihood of damaging a guitar when the guitar is placed in the stand 100. The dampening material can also provide durability to the stand 100 and can reduce the likelihood of damage caused by the stand 100 hitting other objects (e.g. cars, upholstery, walls and flooring) during transport. The dampening material can be a plastic or rubberized material. In one embodiment, the stand 100 is encapsulated with a lining supplied by Rhino Linings USA Inc. It is understood, however, that any suitable rubber, plastic, cloth or other type of material, or combination of materials, capable of providing a cushion and/or protective layer completely or at least partially covering the stand may be utilized in accordance with the present invention.

While various embodiments of the present invention have been described above, it should be understood that they have been presented by way of example only, and not of limitation. Thus the breadth and scope of the present invention should not be limited by any of the above-described exemplary embodiments. Additionally, the invention is described above in terms of various exemplary embodiments and implementations. It should be understood that the various features and functionality described in one or more of the individual embodiments are not limited in their applicability to the particular embodiment with which they are described, but instead can be applied, alone or in some combination, to one or more of the other embodiments of the invention, whether or not such embodiments are described and whether or not such features are presented as being a part of a described embodiment.

For example, although much of this disclosure describes use of the stand 100 in terms of holding the guitar 400, other types of guitars, including both electric and acoustic guitars, can be used with embodiments of the present invention. Moreover, as should be understood, guitars vary in size. Accordingly, the dimensions of the stand 100 can be varied according to the size of the particular guitar that is to be held in the stand 100. The scope of the present invention is also not limited to the various embodiments of stands being used with guitars. For example, embodiments of the present invention can be sized to hold other string instruments, such as violins, banjos, ukuleles, violas and basses. Embodiments of the present invention can also be sized to hold other types of musical instruments, as well as other objects, including various consumer products. Thus, embodiments of the present invention are not limited to the illustrated size, but, instead, the embodiments of the present invention can have various dimensions, depending upon the desired application.

I claim:

1. A support apparatus for holding a musical instrument having a body and neck, the support apparatus comprising:

a base configured to rest on a surface and support a musical instrument thereon, the base comprising:

a pair of at least partly curved metal legs configured to be substantially parallel to one another, a first one of the at least partly curved metal legs comprising at least one hole; a second one of the at least partly curved metal legs comprising a recessed portion configured to avoid contact between the second one of the at least partly curved metal legs and a bridge of the musical instrument; and a pair of metal support beams configured to hold the pair of at least partly curved metal legs parallel to one another, a first one of the metal support beams comprising a recessed portion for accommodating a power cord of the musical instrument, when the musical instrument is placed within an aperture formed by the pair of at least partly curved metal legs and the pair of metal support beams; and a support neck comprising:

a first end comprising at least one reduced diameter section configured to fit in the hole of the first one of the at least partly curved metal legs; and a second end configured to extend upwardly away from the base a distance no greater than a length of the body of the musical instrument, when supported by the apparatus, when the first end is placed within the hole, the second end comprising a magnetic surface configured to magnetically engage a metal portion of the musical instrument.

2. The apparatus of claim 1, wherein the first end of the support neck further comprises a magnetic portion that magnetically couples the first end to the hole.

3. The apparatus of claim 2, wherein when the support neck is disassembled from the base:

the magnetic portion of the first end and the magnetic surface located at the second end magnetically couple in a horizontal fashion to the base; and the recessed portion of the metal support beam accommodates the magnetic surface at the second end of the support neck.

4. The apparatus of claim 1, wherein the magnetic engagement of the magnetic surface and the metal portion is stronger than a force exerted thereon by a combined weight of the apparatus and musical instrument.

5. The apparatus of claim 1, wherein the musical instrument is supported only at the musical instrument body via the base and the magnetic surface.

6. The apparatus of claim 1, wherein at least a portion of the base is encapsulated in a damping material.

7. The apparatus of claim 6, wherein the dampening material comprises at least one of a rubber material, or a plastic material.

8. The apparatus of claim 1, wherein when the musical instrument is placed in the apparatus, only portions of the base are visible when the musical instrument and apparatus are viewed from the front.

9. A stand for holding a guitar that includes a body and a neck extending outwardly from a top portion of the body, the stand comprising:

a base configured to receive and support a bottom portion of the body of the guitar, the base comprising:

a front support member;

a back support member spaced apart from the front support member and extending substantially parallel to the front support member;

a first side support member located on a first side of the base and connecting the front support member to the back support member; and a second side support member located on a second side of the base and connecting the front support member to the back support member, wherein the second side support member further includes a notch sized to accept a power cord connected to the guitar when the guitar is held in the stand;

a support neck having first and second ends, wherein the first end is coupled to a middle portion of the back support member of the base and the second end extends upwardly away from the base; and a magnetic surface coupled to the second end of the support neck, wherein a length of the support neck positions the magnetic surface to engage a metallic element located near the top portion of the body of the guitar when the bottom portion of the body of the guitar is received and supported by the base;

wherein the notch of the second side support member is further configured to receive at least one end of the support neck when the stand is disassembled; and wherein the base comprises a hole for receiving and holding the first end of the support neck and the first end of the support neck comprises a reduced diameter section configured to fit in the hole.

10. The stand of claim 9, wherein the metallic element comprises a metal support neck plate that fastens the neck to the body of the guitar.

11. The stand of claim 9, wherein the metallic element comprises a metallic sticker affixed near the top portion of the body.

12. The stand of claim 9, wherein the front support member includes a recessed portion positioned and sized to allow a bridge of the guitar to avoid contact with the front support member when the bottom portion of the body of the guitar is received and supported by the base.

13. The stand of claim 9, wherein the support neck is detachably coupled to the base.

14. The stand of claim 9, further comprising a glow in the dark material coupled to the magnetic surface.

15. The stand of claim 9, further comprising a logo sticker affixed to the magnetic surface.

16. The stand of claim 9, wherein the support neck extends upwardly away from the base a distance no greater than the length of the body of the guitar.

* * * * *